US006439323B1

(12) United States Patent
Walker

(10) Patent No.: US 6,439,323 B1
(45) Date of Patent: Aug. 27, 2002

(54) SEISMIC SHOTHOLE REAMING MODULE

(75) Inventor: Larry B. Walker, Houston, TX (US)

(73) Assignee: WesternGeco L.L.C., Houston, TX (US)

( * ) Notice: Subject to any disclaimer, the term of this patent is extended or adjusted under 35 U.S.C. 154(b) by 0 days.

(21) Appl. No.: 09/726,632

(22) Filed: Nov. 30, 2000

(51) Int. Cl.[7] ..... E21B 10/66

(52) U.S. Cl. ..... 175/273; 175/286; 175/292; 166/55.3

(58) Field of Search ..... 173/273, 286, 173/292, 293; 166/55.3

(56) References Cited

U.S. PATENT DOCUMENTS 1,710,580 A * 4/1929 Le Bus
3,548,362 A * 12/1970 Blank, Jr.
4,646,826 A * 3/1987 Bailey et al. ..... 166/55.3
5,141,063 A * 8/1992 Quesenbury ..... 175/267

* cited by examiner

*Primary Examiner*—William Neuder
(74) *Attorney, Agent, or Firm*—David S. Figatner; Williams, Morgan & Amerson, P.C.

(57) ABSTRACT

An apparatus for shaping boreholes used in seismic operations. A drill body is attached to a drill bit and is movable in axial and rotational directions. Selective operation of the drill body causes a moveable sleeve to operate a reaming bit to extend through a drill body port and into contact with the borehole wall. A cover seals the portion of the port not covered by the reaming bit to prevent loss of a transport fluid within the drill body and to prevent drill cuttings from entering the drill body interior. The cover can be integrated within the movable sleeve or can comprise a separate component. The force exerted by the drill body against the drill bit can be proportional to the force exerted by the reaming bit against the borehole wall. The reaming bit can be operated separately or simultaneously with operation of the drill bit, and can be retracted and reset to perform another shaping operation at a different position within the borehole.

19 Claims, 3 Drawing Sheets

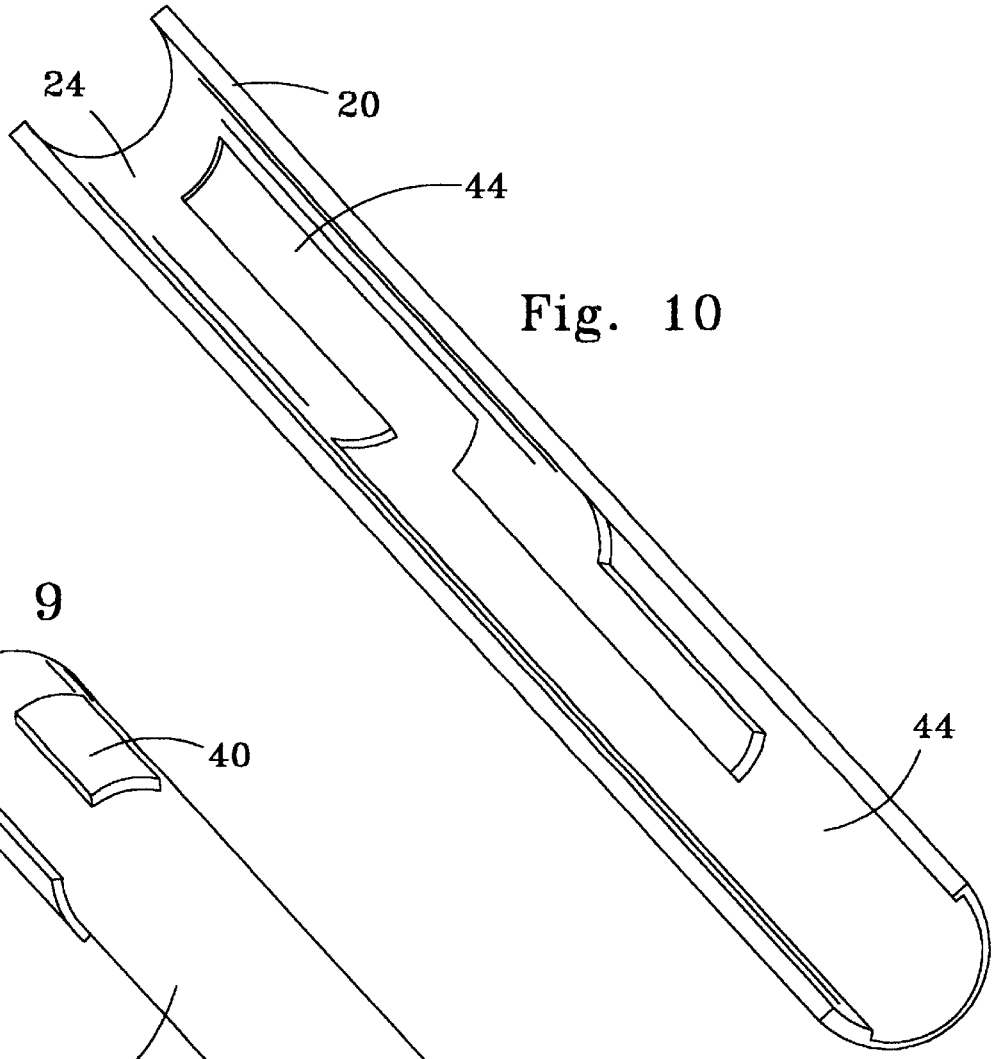
Fig. 10
Fig. 9
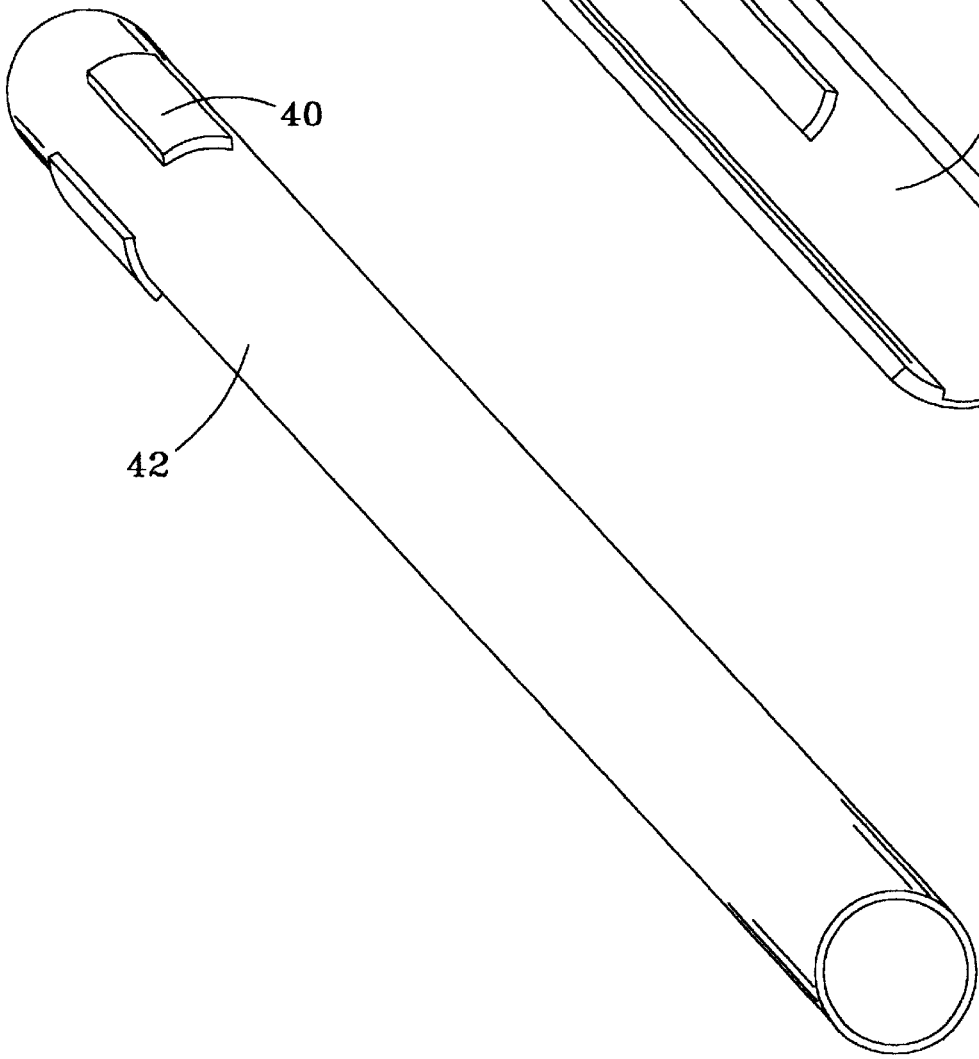

SEISMIC SHOTHOLE REAMING MODULE

BACKGROUND OF THE INVENTION

The present invention relates to the field of geophysical exploration. More particularly, the invention relates to an improved, portable apparatus for drilling and underreaming boreholes for containing explosives in land based seismic operations.

Conventional drill equipment uses flow controlled actuators or bias springs within a drill string to drill and to underream a borehole. Large diameter drill stems manage hydraulic actuators and springs together with associated bearings, gears, cams and guides. Conventional equipment using actuators and springs is illustrated in U.S. Pat. No. 5,351,758 to Henderson et al. (1994), which described a hydraulically actuated mandrel for operating expandable reaming dogs. U.S. Pat. No. 4,893,675 to Skipper (1990) disclosed a section milling tool using pump pressure and a coil spring to operate cutters. U.S. Pat. No. 4,614,242 to Rives (1986) disclosed a mechanical connection between an outer pipe and cutter arms for expanding the cutter arms outwardly to enlarge a borehole. U.S. Pat. No 4,431,065 to Andrews (1984) disclosed an underreamer having a hydraulic plunger for deploying cutting arms.

Seismic shot holes in land based geophysical operations have different requirements unattainable with conventional drilling equipment. Shallow seismic shot holes are slender (less than four inches in diameter) and typically extend less than twenty meters deep. Light duty water or air systems provide a fluid for clearing drill cuttings from the borehole. The narrow cross-section of such boreholes and the associated drilling equipment limits the effectiveness of conventional drill equipment because conventional equipment restricts air flow through the narrow drill pipe diameter. Additionally, seismic shotholes preferably have enlarged sections suitable for installation of explosive material. By enlarging one or more portions downhole in a borehole, extra explosive power can be positioned below the surface to enhance the energy coupling of such explosive power to the geologic formations.

A significant limitation of seismic borehole drill equipment is the need for portability and deployment by a single person. Seismic surveys cross extreme terrain sometimes inaccessible to trucks and other vehicles, and environmental and economic issues further limit the potential use of conventional drill operations. Seismic boreholes are typically positioned every fifty meters and are carried by hand from one location to the next. The portability of manheld portable drill equipment is limited by the weight and volume of the drill equipment. The time required to setup, drill, break down, and move such equipment determines the overall operating efficiency of the drill system.

Various slide rail systems offer an alternate method for reaming a drill hole. Slide or guide rail systems have a rail embedded within the borehole diameter to steer the cutting equipment through openings in the main drill stem. Representative reaming bits using guide rails or slide rails are illustrated in U.S. Pat. No. 4,604,818 to Hachiro (1986) which disclosed a pile bore underreaming bucket, and in U.S. Pat. No. 4,407,376 to Inoue (1983) which disclosed an under-reaming pile bore excavator using guide rails to cross the drill pipe axis. Rail type systems are undesirable in slender seismic boreholes because the rails increase fluid or air turbulence within the borehole and thereby lessen the flow available to flush debris from the borehole.

A need exists for an improved, portable drilling apparatus suitable for drilling and underreaming slender boreholes for seismic operations. The apparatus should be highly portable for use in locations difficult to access and should efficiently create boreholes having the desired shape.

SUMMARY OF THE INVENTION

The invention provides a portable apparatus for engagement with a drill bit and with a drill mechanism for shaping a seismic borehole wall drilled by the drill bit. The apparatus comprises a drill body having an exterior surface and having a lower end connected to the drill bit, wherein the drill body is selectively moveable by the rotating mechanism. A port extends through the drill body exterior surface, and a reaming bit is movably engaged with the drill body and selectively extendible through the port to contact the borehole wall. A switch is operable by movement of the drill body, and a sleeve is activatable by operation of the switch to move within the drill body and to selectively extend the reaming bit through the port. A cover selectively blocks the port. In various embodiments of the invention, the cover can be integrated within the sleeve, the reaming bit can be retractable within the drill body for operation at another position along the borehole wall, and the force exerted by the reaming bit against the borehole wall can be proportional to a force exerted by the drill body against the drill bit.

In another embodiment, the invention provides a portable apparatus for drilling a seismic borehole wall in soil which comprises a movable drill body having an exterior surface and a lower end, a drill bit attached to the drill body lower end for forming a borehole wall in the soil, a port through the drill body exterior surface, a reaming bit movably engaged with the drill body and selectively extendible through the port to contact the borehole wall, a switch operable by movement of the drill body, a sleeve activatable by operation of the switch to move within the drill body and to selectively extend the reaming bit through the port, and a cover for selectively blocking the port.

BRIEF DESCRIPTION OF THE DRAWINGS

FIGS. 9 and 10 illustrate one combination of a switch for selectively operating the movable sleeve.

DESCRIPTION OF THE PREFERRED EMBODIMENTS

Figure 1:
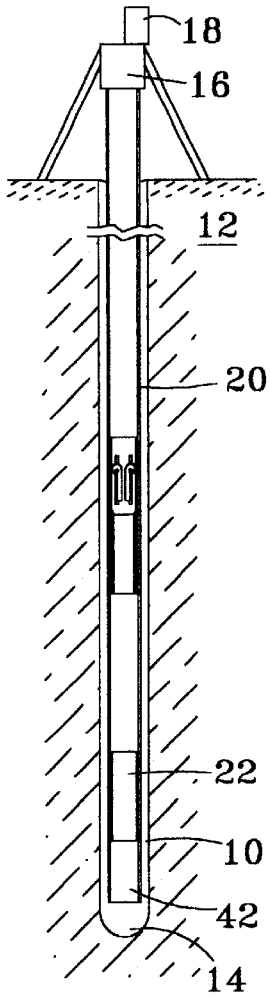
FIG. 1 illustrates a drill body and drill bit operable with a drill mechanism for forming a seismic borehole.

The invention illustrates a highly portable, efficient apparatus for drilling and shaping boreholes used in seismic operations. Referring to FIG. 1, borehole 10 is illustrated in geologic formations 12 and is formed with drill bit 14 rotated or otherwise moved by drive mechanism 16 to form a substantially cylindrical wall defining borehole 10. Pump 18 injects compressed air or a liquid or other fluid into the interior of drill body 20 to provide a transport mechanism for removing drill cuttings from borehole 10.

Figure 2:
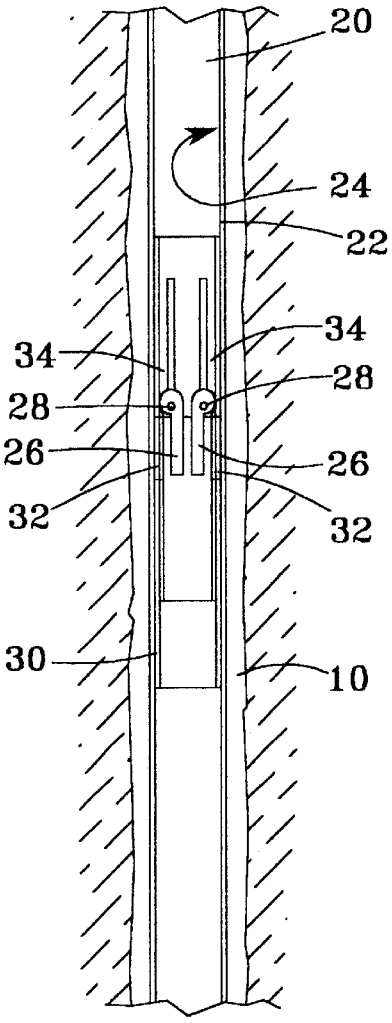
FIG. 2 illustrates an initial position of a sleeve and reaming bits relative to a drill body.

As shown in FIG. 2, drill body 20 comprises a substantially hollow tubular having exterior surface 22 and interior surface 24. Although drill body 20 is shown as cylindrical in shape, other configurations can provide the function of transferring steerage and motive forces between drive mechanism 16 and drill bit 14, and of providing the transport mechanism for conveying the compressed fluid into borehole 10. Drill body 20 supports one or more reaming bits 26 suspended on axles 28 and movable sleeve 30 positioned within the hollow interior of drill body 20. FIG. 2 illustrates reaming bits 26 in an initial position during trip time into borehole 10 or while vertical drilling of borehole 10 is conducted. In such initial position, reaming bits 26 are axially and radially aligned with vertical ports 32 through drill body 20 having an alignment dictated by the orientation of axles 28 and the shape of sleeve 30 and of reaming bits 26. Vertical ports 32 are initially sealed by the upper shutter portion 34 of movable sleeve 30 as shown in FIG. 2. Upper shutter portion 34 provides a cover which prevents leakage of the compressed fluid from within drill body 20 and which prevents intrusion of drill cuttings or other debris contacting exterior surface 22 from entering through vertical ports 32 into the hollow interior of drill body 20.

Figure 3:
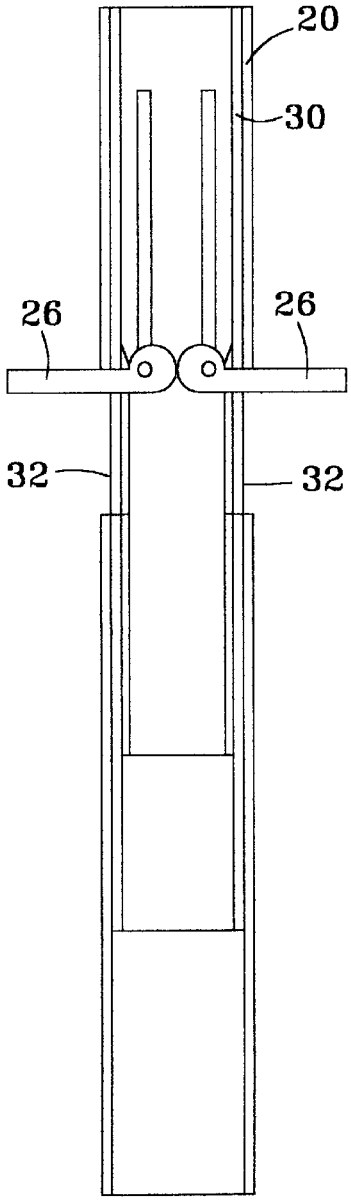
FIG. 3 illustrates operation of a movable sleeve to initiate reaming bit operation.

Referring to FIG. 3, as drill body 20 is rotated counterclockwise, lifted and rotated further counterclockwise, a switch (identified below) facilitates movement of sleeve 30 relative to drill body 20 and permits operation of reaming bits 26 relative to drill body 20 and to geologic formations 12. Upper shutter portion 34 of sleeve 30 opens vertical ports 32 through drill body 20 and permits extension of reaming bits 26 radially outwardly into contact with geologic formations 12. Such radial extension cuts geologic formations 12 and creates an enlarged portion of borehole 10.

Figure 4:
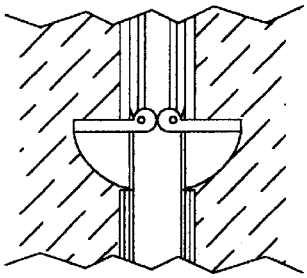
FIG. 4 illustrates a dish shaped borehole expansion.
Figure 5:
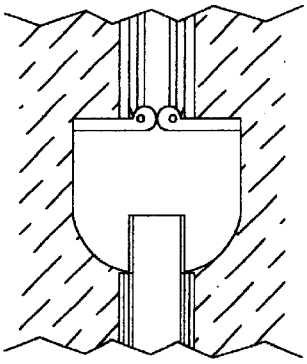
FIG. 5 illustrates a cylindrical borehole expansion.
Figure 6:
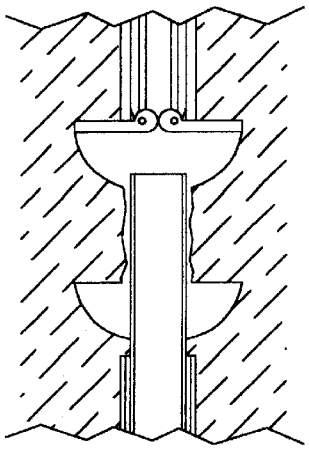
FIG. 6 illustrates a borehole expansion having a shape controlled by movement of the reaming bits relative to the drill body.

As shown in FIG. 4, one representative shape of the borehole 10 enlarged portion can be dish shaped as reaming bits 26 are rotated outwardly. Translation of drill body 20 relative to borehole 10 will cause such dish shapes to be modified to a cylindrical shape as shown in FIG. 5. Various combinations and more complicated shapes for the wall of borehole 10 can be formed with combinations of selective variations of these basic movements, or with different shapes or combinations of reaming bits as shown in FIG. 6.

Figure 7:
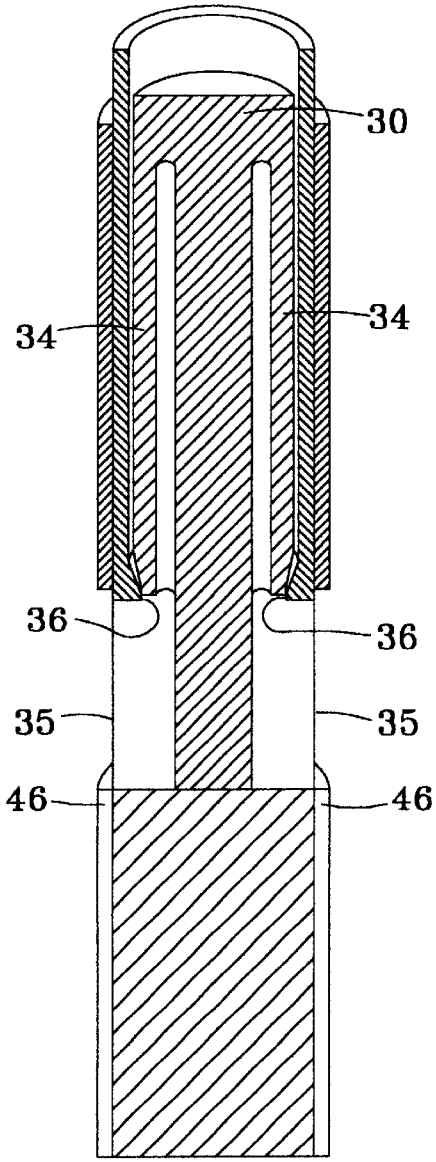
FIG. 7 illustrates one configuration for a movable sleeve.
Figure 8:
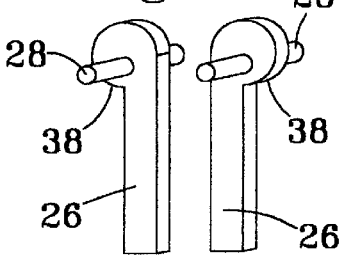
FIG. 8 illustrates one configuration of rotatable reaming bits operable with a movable sleeve.

The form, configuration and operation of reaming bits 26 can be accomplished in many different ways. One type of reaming bits 26 is illustrated in FIGS. 7 and 8, wherein movable sleeve 30 has upper shutter portion 34 for selectively sealing vertical ports 32 through drill body 20. Openings 35 through sleeve 30 permit rotatable movement of reaming bits 26 therethrough. Sleeve 30 also has protrusions 36 for contacting cam surfaces 38 of axles 28. As such contact progresses, reaming bits 26 are rotated outwardly through sleeve openings 35 and ports 32 and into contact with the wall of borehole 10 through geologic formations 12. Additional movement outwardly and movement of drill body 20 causes reaming bits 26 to cut into the wall of borehole 10 to provide a selected shape.

FIGS. 9 and 10 illustrate one combination of a switch for selectively engaging or disengaging movable sleeve 30 relative to drill body 20. Protruding key or keys 40 can be attached to or formed in drill bit 14 or in a sub such as adapter 42 connected between drill bit 14 and drill body 20. Keys 40 can be disposed within grooves, channels or slots 44 formed within interior surface 24 of drill body 20 for operation in different directions and sequences suitable for engaging or disengaging operable components such as moveable sleeve 30. In one embodiment of the invention as illustrated, keys 40 located on an outer wall of adapter 42 are routed such that keys 40 follow slot 44 allowing drill body 20 to slide down the length of adapter 42 toward the bottom of borehole.

In a preferred embodiment of the invention, drill body 20 slides down adapter 42 a selected distance such as six inches further than the position which was held during the vertical drilling effort. As drill body 20 slides down along adapter 42, the upper end of adapter 42 makes contact with the lower end of movable sleeve 30. Movable sleeve 30 then begins to move upward through drill body 20. As the upper shutter 34 rises past reaming bits 26 each protrusion 36 contacts each reaming bit 26 at the edged portion identified as cam surface 38 causing each reaming bit 26 to rotate outward through the now open vertical ports 32. As the lower end of each reaming bit 26 clears the bottom of the respective vertical port 32, the upper end of lower shutter 46 begins to close vertical ports 32 from the bottom end. The axial forces now placed on reaming bits 26 are applied by the upper end of lower shutter 46 and these forces cause reaming bits 26 to extend outward such that each reaming bit 26 bit contacts the wall of borehole 10. When the reaming bits 26 make contact with the borehole 10 wall the downward sliding of drill body 20 stops as the entire drill string is suspended in borehole 10 by reaming bits 26. The downward sliding motion of drill body 20 for a selected distance such as the six inches identified above serves as an indicator to the drilling crew that reaming bits 26 are successfully deployed. Axial and radial forces now applied to the drill body 20 will cause reaming bits 26 to cut outwardly and upward. When fully extended, reaming bits 26 can excavate downward.

For the embodiment of reaming bits 26 identified in FIGS. 7 and 8, a pair of rectangular or cylindrical metal reaming bits 26 are each suspended vertically from a pair of axles 28 which span the diameter of drill body 20. Cutting edges on each bit 26 are configured to enable each reaming bit 26 to excavate upward, outward, and downward along the borehole 10 wall. Vertical openings such as ports 32 in drill body 20 allow reaming bits 26 to pivot outward beyond exterior surface 22 and into contact with the borehole 10 wall. Moveable sleeve 30 located inside drill body 20 provides integral shutters which position and retain reaming bits 26 inside drill body 20, and further seals vertical ports 32 from the loss of flushing air or fluid and prevents intrusion of drilling debris until the reaming process is initiated.

As described above, the reaming process is started with a mechanical matrix or "switch" integral to drill body 20 and to adapter 42. The switch can comprise a series of slots or grooves machined into the inner wall comprising the base of drill body 20. A set of protruding keys 40 are fitted or machined into the outer wall of adapter 42 so that drill body 20 is routed to a specified position within the slot-and-key selector matrix relative to the vertical drill bit adapter or sub. For instance, rotating the drill body 20 one quarter turn counterclockwise, then lifting drill body 20 four inches, then rotating another quarter turn counterclockwise, then lowering drill body 20 eight inches would allow the lower end of movable sleeve to contact the upper end of vertical drill bit adapter 42. After adapter 42 contacts the lower end of movable sleeve 30 and presses upward against moveable sleeve 30, the reaming process is initiated. When the reaming process is initiated, the upper sleeve shutter 34 rises to open vertical ports 32 and simultaneously actuates cam surface 38 integral to the upper end of each reaming bit 26.

This camming function is executed by cam surface 38 protrusion similar to the shape of a single gear tooth located on the inner wall at the bottom edge of upper shutter 34, as it contacts and passes by the upper portion of each reaming bit 26.

Each cam surface 38 pivots the respective reaming bit 26 outward and upward through the corresponding vertical ports 32. As the upper shutter 34 moves upward to allow reaming bits 26 to pivot outward and upward, a portion of sleeve 30 identified in FIG. 7 as lower shutter 46 simultaneously rises to block reentry of each reaming bit 26, to prevent the escape of flushing fluid or air, and to seal against drilling debris intrusion. Lower shutter 46 also redirects the downward forces applied to the drill body 20 upward into reaming bits 26 such that either all of the drilling effort is directed to reaming bits 26 of the drilling effort is distributed to reaming bits 26 and vertical drill bit 14. The force, and consequently the excavation rate applied to reaming bits 26 is controlled by the amount of downward force applied to drill body 20. The mechanical selector matrix or switch is controlled by the amount of downward force applied to the drill body 20. The mechanical selector matrix or switch can be configured to allow vertical drilling simultaneously with the reaming process or can disable vertical drilling during the reaming process. As reaming bits 26 expand outward and upward, a bowl or dish shaped cavity can be formed as shown in FIG. 4. Once the reaming bits reach their maximum hole diameter, further drilling can transform the cavity shape from a dish to a cylinder. Reaming bits 26 can be retracted, guided and locked to their original rest position with upper shutter 34 closed by means of the mechanical switching function of the selector matrix or switch. Once reaming bits 26 are retracted and secured, the vertical drilling effort alone can resume if desired, and the expansion process can be restarted at any time to create a series of cavities with a variety of controlled volumes and shapes.

The length, diameter, shape and cutting edge arrangement of reaming bit or bits 26 can vary depending on the size of the desired cavity, rate of excavation and the general quality of the cavity wall within borehole 10. A single bit or a plurality of bits 26 can be deployed from the same drill body 20 and more than one reaming bit 26 can be located on a single axle 28 with drill body 20. Bit axles 28 can be located inline, adjacent the other, or in different combinations to vary the cutting angle and shape of bits 26. Various functions can be activated directly by the drilling crew to raise, lower and rotate the drill body 20 so that drill body 20 and reaming bit 26 cooperate to provide various cavity shapes.

The seismic borehole reaming process described in the present invention suspends reaming bits 26 on axles 28 inside drill body 20 which provides a conduit to reaming bits 26 for the drilling forces to be applied to the primary drill stem. Reaming bits 26 are capable of reaming outward from a location within the confines of borehole 10 and are capable of reaming in both upward and downward directions. Moveable sleeve 30 is shaped so that multiple functions are integral to the one-piece sleeve 30. Such functions include the ability to retain reaming bits 26 in a specific position inside drill body 20 such that bits 26 are always aligned with vertical ports 32 located in drill body 20. Sleeve 30 releases reaming bits 26 and projects them along a specific path such that they pass through vertical ports 32 of drill body 20. Sleeve 30 minimizes flushing fluid or air loss through vertical ports 32 during all stages of drilling. Sleeve 32 also retrieves reaming bits 26 in a manner such that reaming bits 26 are returned along a specific path to their original resting position and locked into place and aligned with vertical posts ready to deploy on multiple occasions within the same borehole. Sleeve 30 provides the conduit for all available reaming force from drill body 20 to reaming bits 26 during the outward reaming process and the upward reaming process. Force acting on reaming bits 26 is applied directly from drill body 20 during the downward drilling process.

The invention is capable of functioning without hydraulic, pneumatic, or electrical power, or without stored energy techniques such as spring functions for actuating any phase of the reaming process. One or more selector matrixes or switches can be deployed to control various processes along the entire drill string. Flow restrictions are minimized because moving sleeve 30 and pivoted reaming bits 26 within the drill body 20 comprise the only impediments to fluid flow. Drill body 20, sleeve 30 and pivoted bits 26 are integrally shaped to provide direct remote manual control of multiple cycles of guided bit deployment, guided bit retrieval, bit parking and securing, preservation of flushing fluid or flushing air flow, continuous seal against drilling debris intrusion, and direct control of the drilling force applied to reaming bits 26 and drill bit 14. The invention uniquely provides a system for drilling a vertical borehole and for expanding the borehole diameter at one or more locations along the drilled borehole while maintaining direct control over the radial and axial excavating forces applied and over the size, shape and location of each expanded cavity.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A portable apparatus for engagement with a drill bit and with a drill mechanism for shaping a seismic borehole wall drilled by the drill bit, comprising:

a drill body having an exterior surface and having a lower end connected to the drill bit, wherein said drill body is selectively moveable by an axial and rotating mechanism;

a port through said drill body exterior surface;

a reaming bit movably engaged with said drill body and selectively extendible through said port to contact the borehole wall;

a switch operable by movement of said drill body;

a sleeve activatable by operation of said switch to move within said drill body and to selectively extend said reaming bit through said port; and a cover for selectively blocking said port.

2. An apparatus as recited in claim 1, wherein said cover is integrated within said sleeve.

3. An apparatus as recited in claim 1, wherein said reaming bit is capable of cutting the borehole wall as said drill body is moved axially within the borehole.

4. An apparatus as recited in claim 1, wherein said reaming bit is operable to contact the borehole wall while cutting of the drill bit is ceased.

5. An apparatus as recited in claim 1, wherein said reaming bit is operable to contact the borehole wall as the drill bit is rotated to form the borehole wall.

6. An apparatus as recited in claim 1, wherein said drill body is axially and rotatably moveable by the drive mechanism.

7. An apparatus as recited in claim 6, wherein said switch is operable by a selected combination of axial and rotational movement of said drill body.

8. An apparatus as recited in claim 1, wherein said reaming bit is retractable within said drill body and is further extendable to contact the borehole wall at another position on the borehole wall.

9. An apparatus as recited in claim 1, wherein the force exerted by said reaming bit against the borehole wall is proportional to a force exerted by said drill body against the drill bit.

10. An apparatus as recited in claim 1, wherein said switch is attached to said drill body.

11. An apparatus as recited in claim 1, wherein said cover is integrated within said sleeve and is capable of closing the aperture on at least two sides of said reaming bit.

12. A portable apparatus for drilling a seismic borehole wall in soil, comprising:

a movable drill body having an exterior surface and having a lower end;

a drill bit attached to said drill body lower end for forming a borehole wall in the soil;

a port through said drill body exterior surface;

a reaming bit movably engaged with said drill body and selectively extendible through said port to contact the borehole wall;

a switch operable by movement of said drill body;

a sleeve activatable by operation of said switch to move within said drill body and to selectively extend said reaming bit through said port; and a cover for selectively blocking said port.

13. An apparatus as recited in claim 12, further comprising a drive mechanism for selectively moving said drill body axially and rotatably to form the borehole wall.

14. An apparatus as recited in claim 12, further comprising a pump for transporting fluid to said drill bit through said drill body.

15. An apparatus as recited in claim 12, wherein said switch is formed between said drill body and at least one of said drill bit and a sub between said drill body and said drill bit.

16. An apparatus as recited in claim 12, further comprising a cam attached to said sleeve for urging said drill bit through said port.

17. An apparatus as recited in claim 12, wherein said sleeve is capable of locking said reaming bit in a selected extendible position relative to said drill body.

18. An apparatus as recited in claim 12, wherein said cover is integrated within said sleeve.

19. An apparatus as recited in claim 18, wherein said cover selectively blocks said port on at least two sides of said reaming bit.

* * * * *